US011540628B2

(12) United States Patent
Brück et al.

(10) Patent No.: US 11,540,628 B2
(45) Date of Patent: Jan. 3, 2023

(54) MERCHANDISE DISPLAY

(71) Applicant: Oechsle Display Systeme GmbH, Leipheim (DE)

(72) Inventors: Andi Brück, Langenau (DE); André Hofmann, Haldenwang (DE)

(73) Assignee: Oechsle Display Systeme GmbH, Leipheim (DE)

( * ) Notice: Subject to any disclaimer, the term of this patent is extended or adjusted under 35 U.S.C. 154(b) by 0 days.

(21) Appl. No.: 17/455,244

(22) Filed: Nov. 17, 2021

(65) Prior Publication Data

US 2022/0240669 A1 Aug. 4, 2022

(30) Foreign Application Priority Data

Feb. 2, 2021 (DE) ..... 202021000364.9

(51) Int. Cl.

| | |
|---|---|
| ***A47B 57/58*** | (2006.01) |
| ***A47F 1/12*** | (2006.01) |
| ***A47F 3/00*** | (2006.01) |
| ***A47F 5/00*** | (2006.01) |
| ***G08B 7/06*** | (2006.01) |
| ***G08B 13/14*** | (2006.01) |

(52) U.S. Cl.

CPC ..... *A47B 57/583* (2013.01); *A47F 1/126* (2013.01); *A47F 3/004* (2013.01); *A47F 5/005* (2013.01); *G08B 7/06* (2013.01); *G08B 13/1436* (2013.01)

(58) Field of Classification Search

CPC ... A47B 57/583; A47B 57/585; A47B 57/586; A47B 65/10; A47B 65/15; A47F 1/126; A47F 5/005; A47F 1/128; A47F 5/0861; A47F 7/144; A47F 3/002; A47F 3/02; A47F 5/0068; A47F 5/0025; A47F 3/004; G08B 7/06; G08B 13/1436; E05B 69/006

USPC .... 211/59.3, 7, 43, 49.4, 184, 59.4, 119.003

See application file for complete search history.

(56) References Cited

U.S. PATENT DOCUMENTS

| | | | | | |
|---|---|---|---|---|---|
| 1,506,204 | A * | 8/1924 | Snoddy | A47B 65/15 | 211/43 |
| 2,494,382 | A * | 1/1950 | Faulkner | A47B 19/04 | 312/334.26 |
| 2,675,922 | A * | 4/1954 | Hamaker | A47B 65/15 | 211/11 |
| 2,889,055 | A * | 6/1959 | Weller | A47B 57/58 | 211/184 |
| 3,408,128 | A * | 10/1968 | Kump | A47F 3/00 | 312/294 |
| 3,893,739 | A * | 7/1975 | Bernard | A47B 57/585 | 211/74 |
| 4,037,728 | A * | 7/1977 | Cameron | A47G 25/1457 | 211/124 |
| 4,830,201 | A * | 5/1989 | Breslow | A47F 1/126 | 211/59.3 |

(Continued)

*Primary Examiner* — Jennifer E. Novosad
(74) *Attorney, Agent, or Firm* — Smartpat PLC

(57) ABSTRACT

A merchandise display device includes a plurality of merchandise compartments, separated from one another by means of a merchandise divider, and displaceable slats delimiting these merchandise compartments in a common dispensing area. The merchandise display device has a base plate and two side walls connected to it. In addition, a slat rail carrying the slats is attached to both side walls. The merchandise display device that can be easily assembled and adapted.

27 Claims, 4 Drawing Sheets

(56) References Cited

U.S. PATENT DOCUMENTS 4,887,737 A * 12/1989 Adenau ..... A47F 1/126 221/192
5,018,627 A * 5/1991 Moore ..... A47G 25/0692 206/291
5,082,125 A * 1/1992 Ninni ..... A47F 5/005 211/184
5,217,122 A * 6/1993 Martinez ..... A47B 97/00 211/184
5,228,578 A * 7/1993 Wu ..... A47B 65/20 211/175
5,408,775 A * 4/1995 Abramson ..... G09F 3/18 40/655
5,449,076 A * 9/1995 Van Noord ..... A47F 5/01 211/59.3
5,765,390 A * 6/1998 Johnson ..... A47F 5/005 312/405.1
6,389,991 B1 * 5/2002 Morrisson ..... A47B 57/585 211/184
D509,393 S * 9/2005 Winig ..... D6/574
7,451,881 B2 * 11/2008 Hardy ..... A47F 5/0018 211/175
7,828,158 B2 * 11/2010 Colelli ..... A47F 3/002 211/59.3
7,850,022 B2 * 12/2010 Fulmer ..... H05K 7/1425 211/186
8,622,227 B2 * 1/2014 Bird ..... A47F 3/002 211/119.003
8,800,811 B2 * 8/2014 Sherretts ..... A47F 1/128 221/126
9,240,090 B2 * 1/2016 Vogler ..... G07F 11/38
9,820,585 B2 * 11/2017 Hardy ..... A47F 5/005
11,304,514 B2 * 4/2022 Lanphear ..... A47B 57/588
11,357,341 B2 * 6/2022 Ewing ..... G08B 13/194
2004/0060944 A1 * 4/2004 Gervasi ..... A47F 3/002 221/263
2005/0139560 A1 * 6/2005 Whiteside ..... A47F 5/005 211/119.003
2005/0274681 A1 * 12/2005 Rivers ..... A47B 65/00 211/43
2009/0277853 A1 * 11/2009 Bauer ..... A47F 1/087 211/59.3
2012/0285906 A1 11/2012 Bird et al.
2014/0305891 A1 * 10/2014 Vogler ..... A47F 1/126 211/59.3
2016/0132823 A1 * 5/2016 Swafford ..... G06Q 10/087 705/28
2019/0282000 A1 * 9/2019 Swafford ..... A47F 10/02
2021/0142262 A1 * 5/2021 Bellgardt ..... G07C 3/00
2022/0240669 A1 * 8/2022 Brück et al. ..... G08B 13/1436

* cited by examiner

MERCHANDISE DISPLAY

CROSS-REFERENCE TO RELATED APPLICATION

This application claims the benefit of German Patent Application No. 20 2021 000 364.9, filed 2 Feb. 2021, the contents of which is hereby incorporated by reference in its entirety.

TECHNICAL FIELD

The disclosure relates to a merchandise display device with a plurality of merchandise compartments, separated from one another by a merchandise divider, and with displaceable slats delimiting these merchandise compartments in a common dispensing area.

BACKGROUND

A merchandise display device is known from US 2012/028 5906 A1, the slats being guided in a rail attached to the shelf above.

SUMMARY

The present disclosure provides a merchandise display device that can be easily assembled and adapted. The merchandise display device has a base plate and two side walls connected to it. In addition, a slat rail carrying slats is attached to both side walls.

The merchandise display device is a complete assembly that can be mounted as a whole rigidly or movably on a shelf. The merchandise dividers and the side walls delimit the individual merchandise compartments. Towards a customer, these merchandise compartments are delimited by the slats, so that only limited access to the merchandise is possible. During assembly, the merchandise display device is fixed on the shelf or on pull-out rails that may be attached to the shelf. In order to adapt the merchandise display device to new merchandise or to a new arrangement of merchandise, the slat rail with the slats can be removed from the side walls carrying them. The slat rail or a new slat rail with a new slat arrangement can then be reinserted into the side walls as an insert unit.

The following detailed description is merely exemplary in nature and is not intended to limit the invention or the application and uses of the invention. Furthermore, there is no intention to be bound by any theory presented in the preceding background or the following detailed description.

DETAILED DESCRIPTION

Figure 1:
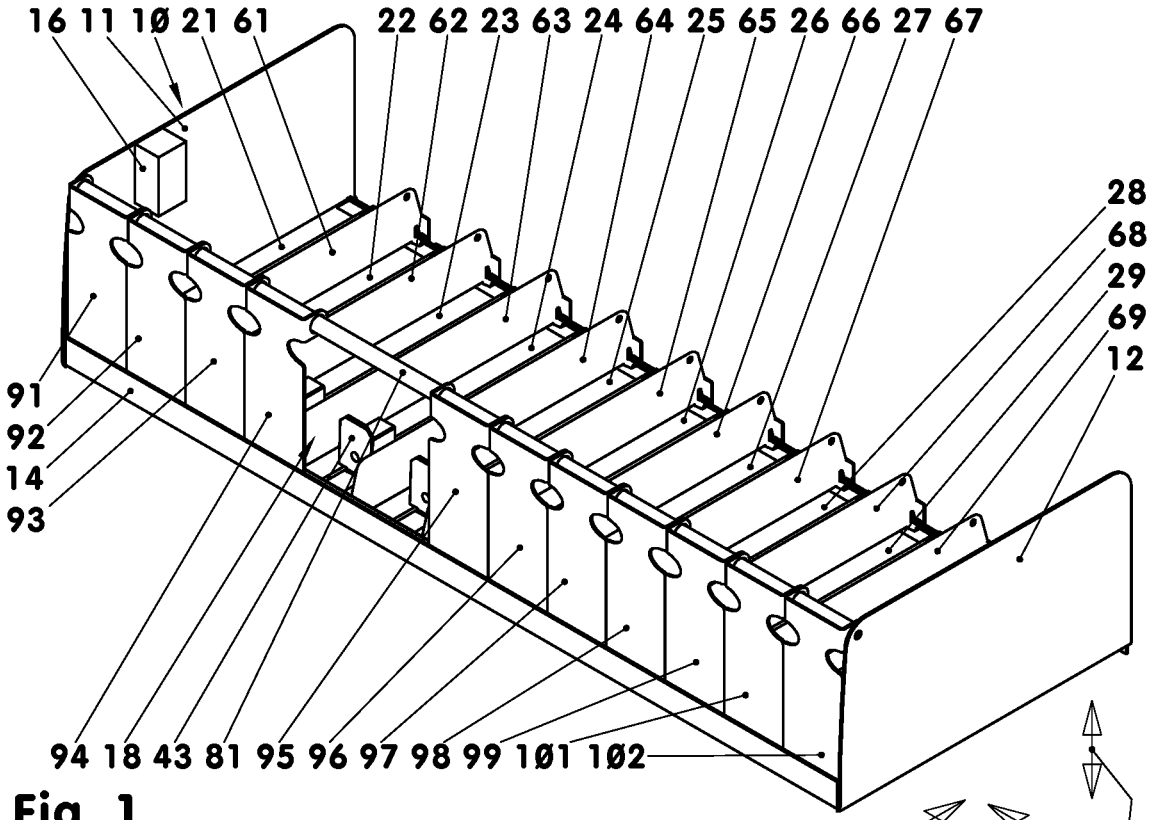
FIG. 1 shows a merchandise display device.
Figure 2:
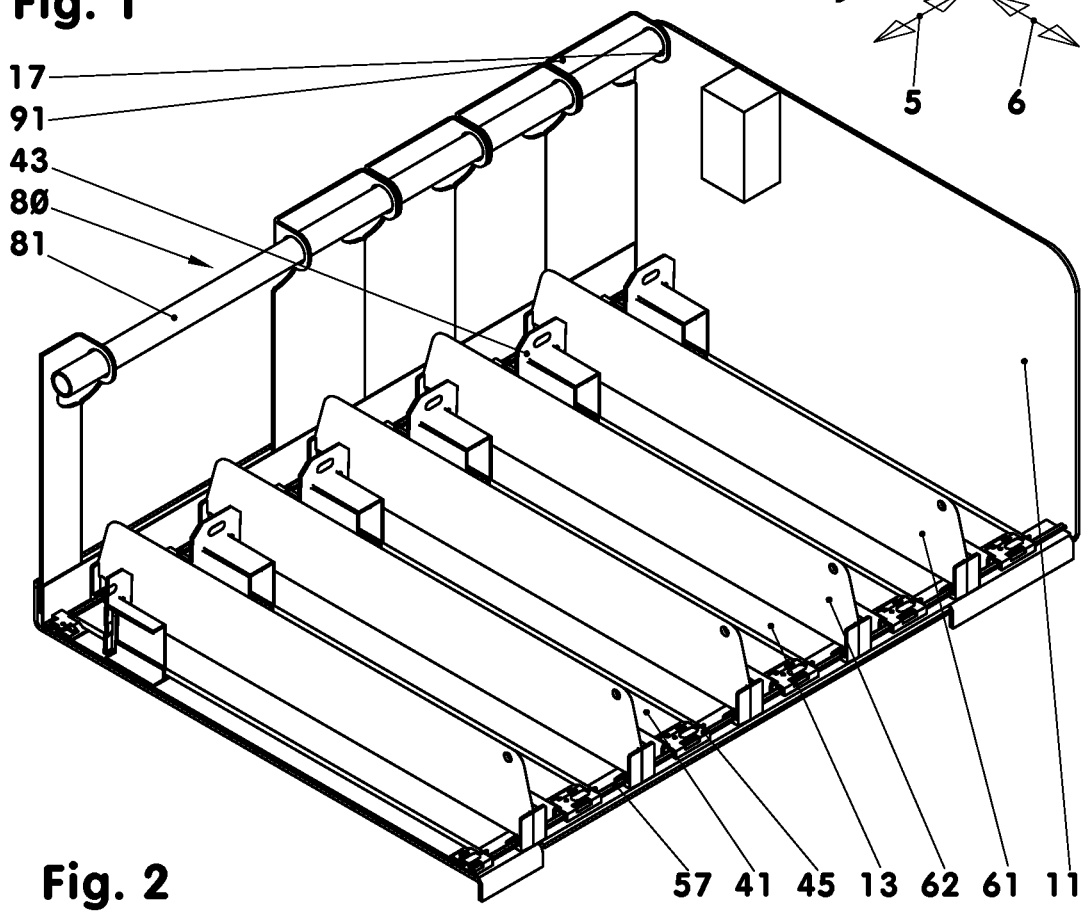
FIG. 2 is a perspective sectional view of the merchandise display device as in FIG. 1.
Figure 3:
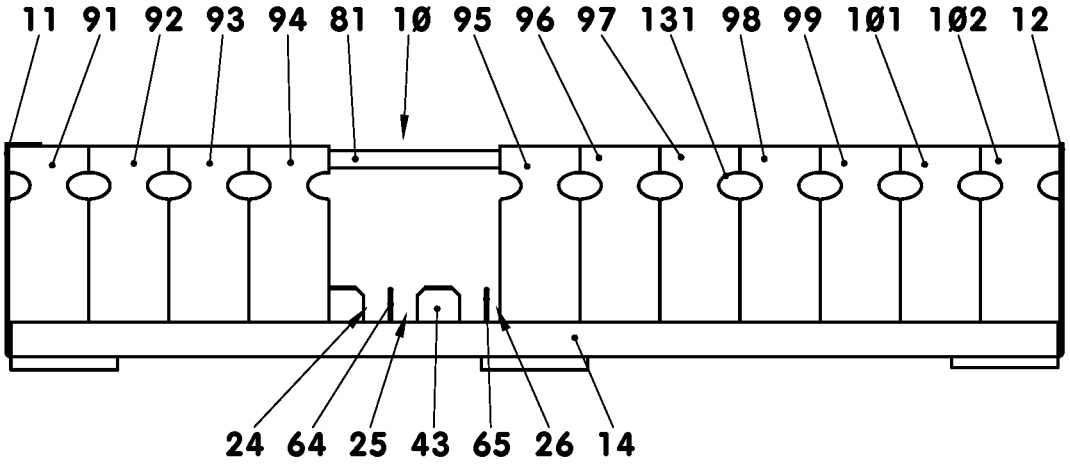
FIG. 3 is a front view of the merchandise display device.
Figure 4:
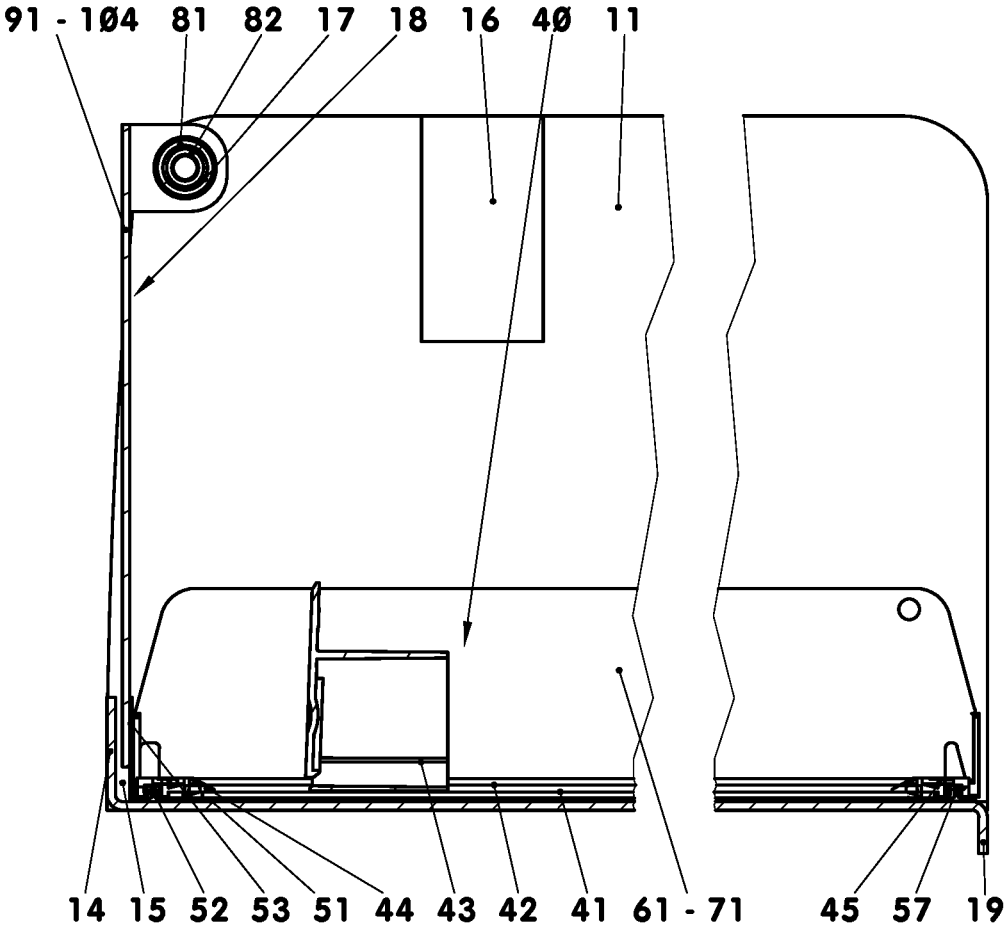
FIG. 4 is a longitudinal section of the merchandise display device.

FIGS. 1-6 show a merchandise display device (10) and some of its individual parts. The merchandise display device (10) comprises a plurality of merchandise compartments (21-32). In the exemplary embodiment shown, the merchandise display device (10) has eleven merchandise compartments (21; 22; 23; 24; 25; 26; 27; 28; 29; 31; 32). These merchandise compartments (21-32) are arranged, for example, parallel to one another. They open into a common dispensing area (18). This dispensing area (18) lies, for example, in a normal plane to the common longitudinal direction (5) of all merchandise compartments (21-32). It is also conceivable to arrange the individual merchandise compartments (21; 22; 23; 24; 25; 26; 27; 28; 29; 31; 32) with crossing, diverging or intersecting longitudinal directions. The dispensing area (18) is then, for example, a uniaxially or multiaxially curved surface or a surface configured to be undulating in the transverse direction (6). In such an embodiment, the merchandise display device (10) may have a cylindrical section-shaped envelope contour instead of the illustrated cuboid envelope contour.

The individual merchandise compartments (21; 22; 23; 24; 25; 26; 27; 28; 29; 31; 32) in the exemplary embodiment have the same width (w) oriented in the transverse direction (6). The merchandise compartments (21-32) can, however, also have different widths. In that case, there is at least one narrowest merchandise compartment (21; 22; 23; 24; 25; 26; 27; 28; 29; 31; 32) and at least one widest merchandise compartment (32; 31; 29; 28; 27; 26; 25; 24; 23; 22; 21). The individual merchandise compartments (21; 22; 23; 24; 25; 26; 27; 28; 29; 31; 32) have the same height in the exemplary embodiment. However, it is also conceivable to design individual merchandise compartments (21; 22; 23; 24; 25; 26; 27; 28; 29; 31; 32) with different heights.

The individual merchandise compartment (21; 22; 23; 24; 25; 26; 27; 28; 29; 31; 32) has a U-shaped support profile (41) with inwardly oriented support surfaces (42). The merchandise to be presented can be lined up one behind the other on the support surfaces (42). The merchandise is pushed towards a front stop (53) by a spring-loaded merchandise slide (43). The spring used here is, for example, a constant force spring which is fastened in a front anchor (44) fastened to the support profile (41) and can be rolled up onto a coil in the merchandise slide (43). If necessary, a rotary damper connected in series with the constant force spring can also be arranged in the merchandise slide (43).

The individual front anchor (44) sits on a T-shaped transverse bar (52). This transverse bar (52) is part of a front stop bar (51). The width of the front stop bar (51) oriented in the transverse direction (6) corresponds to the width of the merchandise display device (10). The L-shaped front stop bar (51) has the front stop (53) as a vertical leg. A rear transverse bar (57) arranged at the rear end of the respective merchandise compartment (21; 22; 23; 24; 25; 26; 27; 28; 29; 31; 32) is supported by a rear anchor (45) which is, for example, formed identical to the front anchor (44).

Merchandise dividers (61-71) are fixed on the two transverse bars (52, 57). One merchandise divider (61; 62; 63; 64; 65; 66; 67; 68; 69; 71) each separates two merchandise compartments (21, 22; 22, 23; 23, 24; 24, 25; 25, 26; 26, 27; 27, 28; 28, 29; 29, 31; 31, 32) from one another. The individual merchandise divider (61; 62; 63; 64; 65; 66; 67; 68; 69; 71) is plate-shaped. The height of the individual merchandise divider (61; 62; 63; 64; 65; 66; 67; 68; 69; 71) is, for example, 30% of the height of the individual merchandise compartment (21; 22; 23; 24; 25; 26; 27; 28; 29; 31; 32). The merchandise dividers (61-71) can however also be made higher. For example, their height can be 50% of the height of a merchandise compartment (21; 22; 23; 24; 25; 26; 27; 28; 29; 31; 32). It is also conceivable that the height of the individual merchandise divider (61; 62; 63; 64; 65; 66; 67; 68; 69; 71) corresponds at least approximately to the height of the merchandise compartment (21; 22; 23; 24; 25; 26; 27; 28; 29; 31; 32) delimited by the merchandise divider (61; 62; 63; 64; 65; 66; 67; 68; 69; 71). The thickness of the individual merchandise divider (61; 62; 63; 64; 65; 66; 67; 68; 69; 71) is, for example, less than 3% of the width of a merchandise compartment (21; 22; 23; 24; 25; 26; 27; 28; 29; 31; 32).

Two side walls (11, 12) delimit the merchandise display device (10) in the transverse direction (6). The height of the side walls (11, 12) corresponds, for example, to the height of the merchandise compartments (21-32). The distance between the two side walls (11, 12) corresponds to the sum of the widths of all merchandise compartments (21-32) and the merchandise dividers (61-71). The thickness of the individual side wall (11; 12) is 2.5 millimeters in the exemplary embodiment. However, the two side walls can also have a different thickness.

A base plate (13) connects the two side walls (11, 12). In the exemplary embodiment, the base plate (13) and the two side walls (11, 12) are a plastic part with multiple folds. That is, the two side walls (11, 12) may be integrally molded with the base plate (13) and extend upwardly perpendicular to the base plate. The two side walls (11, 12) are arranged parallel to each other on opposite ends of the base plate (13). The base plate (13) and the side walls (11, 12) can also be separate components. The base plate (13) is bent upwardly in the area of the dispensing area parallel to the front stop (53) as a front strip (14). The front stop (53) and the front strip (14) are spaced apart from one another by a guide groove (15) of constant cross section. A downwardly folded securing strip (19) is arranged at the rear end of the base plate (13).

An alarm system (16) may be arranged on a side wall (11; 12). The distance between the alarm system (16) and the base part (13) is, for example, greater than half the height of a merchandise compartment (21-32). The alarm system (16) comprises, for example, an acceleration sensor and an acoustic and/or optical signal generator. The signal generator can output a simple beep, for example, as an acoustic signal. However, it is also conceivable to connect the alarm system (16) to video surveillance, a public address system, a remote alarm, etc.

Figure 5:
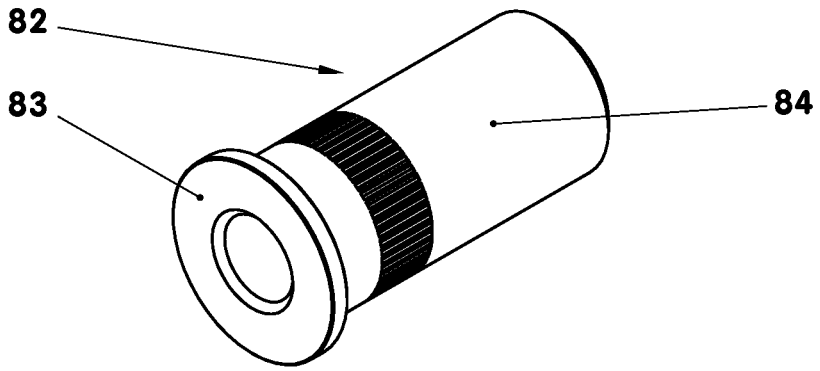
FIG. 5 shows a retaining pin.

A slat rail (81) is arranged between the side walls (11, 12) in the upper region of the merchandise display device (10). This slat rail (81) is fixed on both sides in the side walls (11, 12). For example, a retaining pin (82) which is inserted from the outside and engages in the slat rail (81) is used for this purpose. FIG. 5 shows such a retaining pin (82). The retaining pin (82) is a collar pin with an internal thread. In the exemplary embodiment, it is made of aluminum. The diameter of the collar (83) is larger than the diameter of an associated side wall bore (17). The diameter of the cylindrical area (84) of the retaining pin (82) is smaller than the side wall bore (17) and smaller than the inner diameter of the slat rail (81). The slat rail (81) cannot therefore be pulled out from the front of the merchandise display device (10). Other embodiments of the fixation of the slat rail (81) are also conceivable.

In the exemplary embodiment, the slat rail (81) is designed as a straight, cylindrical tube with a constant diameter. This diameter in a plane normal to the longitudinal direction (5) is, for example, greater than five times the thickness of a side wall (11; 12). In the exemplary embodiment, this diameter is 6.4 times the thickness of the side walls (11, 12). The slat rail (81) is arranged, for example, normal to the longitudinal directions (5) of the merchandise compartments (21-32) and parallel to the base plate (13). However, it is also conceivable to design the slat rail (81), for example, to be arched or wave-shaped in a top view. For example, the slat rail (81) can be designed like the top view of the dispensing area (18). In a front view of the merchandise display device (10), the slat rail (81) can also have upward or downward bends or curvatures along the transverse direction (6). The angle of inclination of the slat rail (81) to the horizontal is, for example, less than 15 degrees in each case. The slat rail (81) can also have an elliptical, square, rectangular, etc. cross section.

A plurality of slats (91-102) hang on the slat rail (81). The minimum number of slats (91-102) corresponds, for example, to one fewer than the number of merchandise compartments (21-32). In the exemplary embodiment, the number of slats (91-102) corresponds to the number of merchandise compartments (21-32). For example, all of the slats (91-102) are designed to be identical to one another. All slats (91-102) are slidably guided on the slat rail (81) and also in the guide groove (15).

Figure 6:
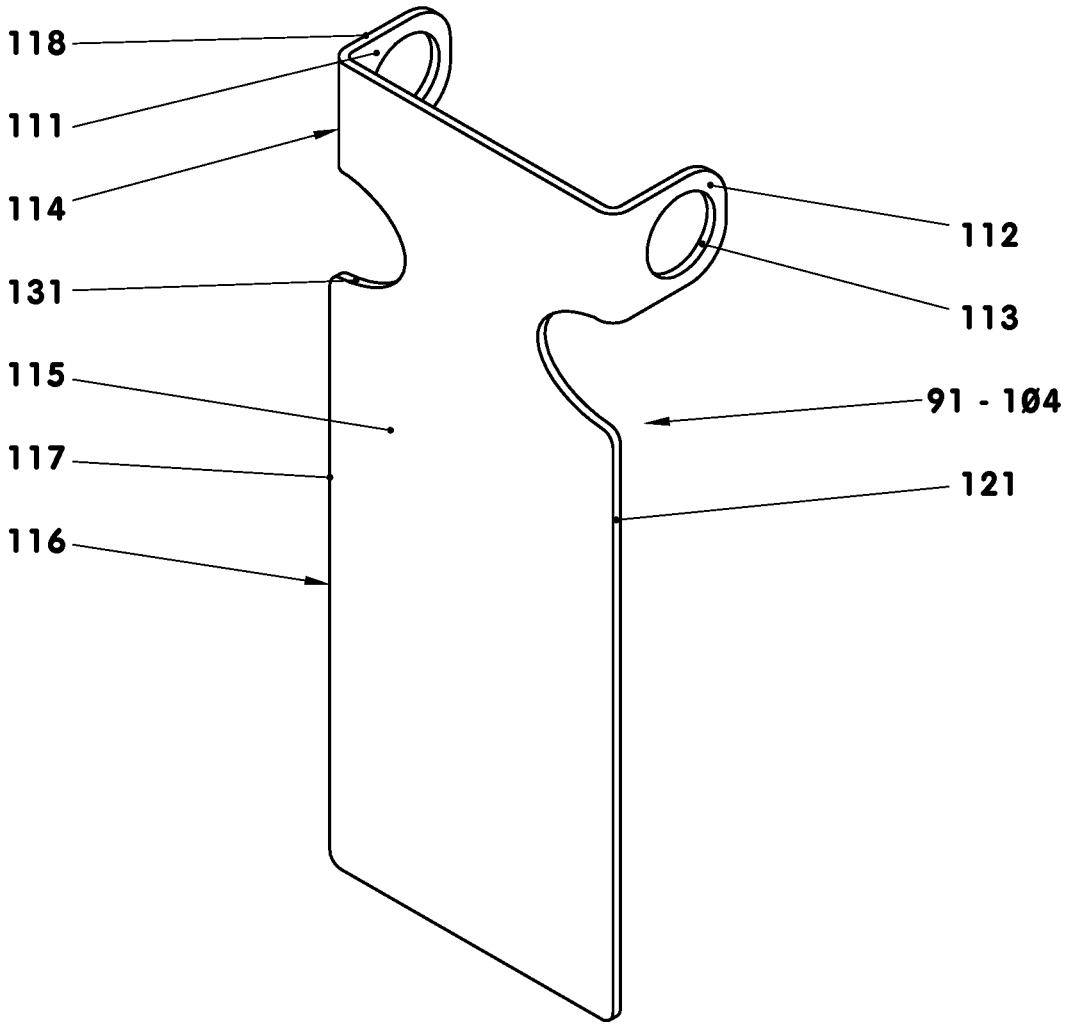
FIG. 6 shows a slat.

FIG. 6 shows a single slat (91; 92; 93; 94; 95; 96; 97; 98; 99; 101; 102) of this first embodiment. The individual slat (91; 92; 93; 94; 95; 96; 97; 98; 99; 101; 102) is made of a transparent plastic, for example. Possibly, the individual slat (91; 92; 93; 94; 95; 96; 97; 98; 99; 101; 102) can have a label. Its thickness is, for example, 2% of the width of a merchandise compartment (21-32). The width (b) of the slat (91; 92; 93; 94; 95; 96; 97; 98; 99; 101; 102) is, for example, 83% of the width of a merchandise compartment (21-32). Its height is, for example, twice the width of a merchandise compartment (21-32).

In the upper area of the slat (91-102), two guide lugs (111, 112) protrude in the longitudinal direction (5). These guide lugs (111, 112) are formed parallel to one another. A receiving bore (113) penetrates both guide lugs (111, 112). The diameter of the receiving bore (113) is, for example, 12% larger than the diameter of the slat rail (81). This upper area of the slat (91-102) forms a transverse guide area (114) in the exemplary embodiment.

The lower area of the slat (91-102) is designed as a flat plate in this exemplary embodiment. The width of this lower area corresponds, for example, to the width of the slat (91-102) in the area of the guide lugs (111, 112). However, the lower area can also be made narrower or wider than the upper area. In this exemplary embodiment, the lower area forms a tongue (115). This area is also referred to below as the tongue area (116). The individual slat (91-102) can also be curved in one or two axes.

The individual tongue (115) has engagement recesses (131) on both transverse sides. The individual engagement recess (131) is, for example, semi-elliptical. In the exemplary embodiment, the main axis of the ellipse has an imaginary length of 20 millimeters. The length of the minor axis is 0.63 times this length. Instead of the engagement recess (131), the slat (91-102) can also have one or two finger recesses, handles, etc.

Figure 7:
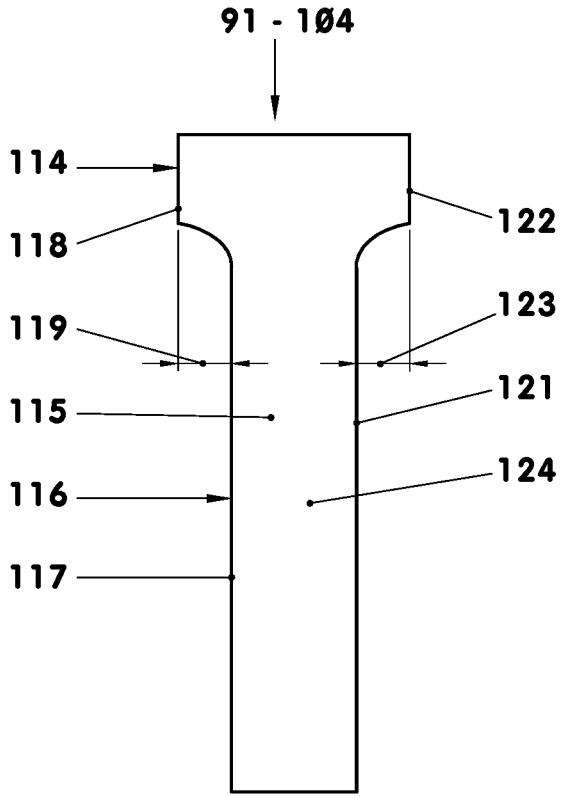
FIG. 7 shows a variant of a slat.

FIG. 7 shows a variant of a slat (91-104). The transverse guide area (114) is designed like the transverse guide area (114) of the slat (91-104) shown in FIG. 6. The width of the slat (91-104) of FIG. 7 is, for example, 87% of the width of the slat (91-104) shown in FIG. 6. The tongue (115), which may be arranged, for example, centrally to the transverse guide area (114), has half the width of the transverse guide area (114). The distance on the left in this FIG. 7 between the left tongue edge (117) and the left edge (118) of the transverse guide region (114) is referred to below as the left overhang (119) (u). The right-hand distance between the right tongue edge (121) and the right edge (122) of the transverse guide region (114) is referred to as the right overhang (123) (v). In the case of a V-shaped design of the tongue (115) or a curved design of the tongue edges (117, 121), the average overhang of these embodiments are considered to be the overhangs (119, 123).

Figure 8:
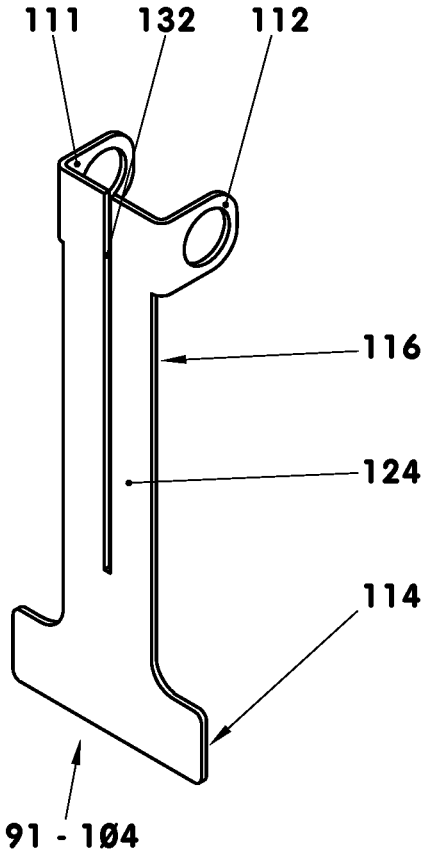
FIG. 8 shows another variant of a slat.

In the case of the slat (91-104) shown in FIG. 8, the distance between the guide lugs (111, 112) is halved compared to the embodiment in FIG. 6. For example, the area of the guide lugs (111, 112) in this exemplary embodiment is part of the tongue (115). In this exemplary embodiment, the transverse guide area (114) is arranged at the lower end of the slat (91-104). Furthermore, the slat (91-102) shown in FIG. 8 has a vertical slot (132).

When assembling the merchandise display device (10), for example, the front stop bar (51) and the rear transverse bar (57) are first attached to the base plate (13). The pre-assembly groups (40), each consisting of a support profile (41), a merchandise slide (43), a front anchor (44) and a rear anchor (45) together with their accessories, are attached to the transverse bars (52, 57) in such a way that both the front anchor (44) as well as the rear anchor (45) reach around the transverse bars. The pre-assembly groups (40) can be displaced in the transverse direction (6). A pre-assembly group (40) can also have a sliding plate. A merchandise divider (61-71) each is inserted between the individual pre-assembly groups (40). Here, the individual merchandise compartments (21-32) are designed, for example, in such a way that the width of the individual merchandise compartment (21; 22; 23; 24; 25; 26; 27; 28; 29; 31; 32) is a maximum of 20% wider than the width of the merchandise to be received. The difference between the width of the merchandise compartment (21; 22; 23; 24; 25; 26; 27; 28; 29; 31; 32) and the width of the merchandise to be received is the transverse play of the merchandise during conveyance and removal.

The individual slats (91-104) are pushed onto the slat rail (81) in such a way that the slat rail (81) penetrates the receiving bores (113) of all the slats (91-104). The slats (91-104) may all oriented in the same direction. For example, the visible side (124) of all slats (91-104) faces outwards. The insert unit (80) consisting of the slat rail (81) and the slats (91-104) is inserted as a whole into the previously assembled subassembly and secured by the retaining pins (82). The insert unit (80) can also be retrofitted to an existing assembly.

It is also conceivable to use slats (91-104) of different widths in the insert unit (80). For example, after the merchandise display device (10) has been assembled, the widest slats (91; 92; 93; 94; 95; 96; 97; 98; 99; 101; 102; 103; 104) are in front of the widest merchandise compartments (21; 22; 23; 24; 25; 26; 27; 28; 29; 31; 32) in the dispensing area and the narrowest slats (104; 103; 102; 101; 99; 98; 97; 96; 95; 94; 93; 92; 91) in the area in front of the narrowest merchandise compartments (32; 31; 29; 28; 27; 26; 25; 24; 23; 22; 21).

The merchandise display device (10) can be closed by a cover. A further merchandise display device (10) can also be placed on the first-mentioned merchandise display device (10).

After assembling the merchandise display device (10), the sum of the widths (b) of all slats (91-102) measured in the transverse direction (6) is greater than the sum of the widths (w) of all merchandise compartments (21-32), reduced by the width of the narrowest merchandise compartment (102, 101, 99, 98, 97, 96, 95, 94, 93, 92, 91) and the narrower of the merchandise compartments adjacent thereto (21, 22, 23, 24, 25, 26, 27, 28, 29, 31, 32). At the same time, the sum of the widths (b) of the slats (91-102) is smaller than the sum of the widths (w) of all merchandise compartments (21-32) except for the widest merchandise compartment (21, 22, 23, 24, 25, 26, 27, 28, 29, 31, 32). The slats (91-102) can be moved freely along the slat rail (81).

The merchandise display device (10) can now be mounted as a whole in a shelving unit. It can, for example, reach behind the shelf by the securing strip (19). The merchandise display device (10) can for example be attached to the shelf in a perforated grid. Fixing by means of magnetic strips, dowels, etc. is also conceivable. The merchandise display device (10) can also be inserted in, for example, two pull-out rails. The merchandise display device (10) can then be pulled out relative to the shelf, for example. In this case, it is designed, for example, to be lockable in the pushed-in position relative to the shelf.

Merchandise can be loaded, for example, from the dispensing side (18). All merchandise compartments (21-32) can also be filled after the insert unit (80) has been removed. In the case of a pull-out merchandise display device (10), the individual merchandise compartments (21-32) can be loaded from above after the merchandise display device (10) has been unlocked and pulled out in a drawer-like manner.

In the merchandise display device (10) each of the merchandise compartments is accessible to the customer. The transparent material of the slats (91-104) enables good visibility of the merchandise. Therein, for example, access is only possible to one merchandise compartment (21; 22; 23; 24; 25; 26; 27; 28; 29; 31; 32) at a time. For this purpose, the individual slats (91-104) are arranged to be displaceable in the transverse direction (6) of the merchandise display device (10). The transverse direction (6) is oriented along the straight or curved slat rail (81). Each individual slat (91; 92; 93; 93; 94; 95; 96; 97; 98; 99; 101; 102; 103; 104) is guided twice, at its top and at its bottom, so that it is difficult for the slats (91-104) to be removed or broken off. The merchandise presented by means of the merchandise display device (10) are thus additionally protected against unauthorized removal.

Individual merchandise compartments (21; 22; 23; 24; 25; 26; 27; 28; 29; 31; 32) can be locked individually. For this purpose, they can either be locked relative to the base part (13) or displaceable to a limited extent in the dispensing area (18) of the respective merchandise compartment (21-32). With such a limited displaceability of a slats (91-104), the merchandise compartment (21-32) behind it is not released, so that removal of merchandise from this merchandise compartment (21-32) is prevented. Merchandise can then only be removed from the corresponding merchandise compartment (21-32), for example, after the corresponding slat (91-104) has been unlocked by the staff.

In the merchandise display device (10), each merchandise slide (43) moves the merchandise stored in the respective merchandise compartment (21-32) in the direction of the front stop (53). For example, each merchandise compartment (21-32) is initially closed by at least one slat (91-104) in the dispensing area (18). If a customer wants to remove merchandise from a merchandise compartment (21-32), he moves the slats (91-104) on both sides of this merchandise compartment (21; 22; 23; 24; 25; 26; 27; 28; 29; 31; 32), for example after inserting his finger into the engagement recesses (131). The design of the engagement recess (131) prevents injury to the customer. The slats (91-104) can be pushed apart so that exactly one merchandise compartment (21; 22; 23; 24; 25; 26; 27; 28; 29; 31; 32) is released over its entire width. However, the maximum distance between the pushed-apart slats (91-104) is smaller than the sum of the width of this merchandise compartment and the narrower one of the merchandise compartments (21; 22; 23; 24; 25; 26; 27; 28; 29; 31; 32) arranged to the right and/or left thereof.

After the merchandise has been removed, the merchandise remaining in the merchandise compartment (21-32) is slowly moved in the direction of the front stop (53) by the merchandise slide (43). The customer can now take further merchandise from this merchandise compartment (21-32).

In order to remove merchandise from another merchandise compartment (21; 22; 23; 24; 25; 26; 27; 28; 29; 31; 32), the customer moves the corresponding slats (91-104) covering the merchandise compartment (21; 22; 23; 24; 25; 26; 27; 28; 29; 31; 32) to the right and to the left. The removal of one or more goods from this compartment takes place as described above. A gripping of merchandise from adjacent merchandise compartments (21-32) through the opening of the dispensing area (18) of a first merchandise compartment (21; 22; 23; 24; 25; 26; 27; 28; 29; 31; 32) is prevented, inter alia, by the merchandise divider (61-71). When the slats (91-104) are moved rapidly, the resulting impulse of the slats (91-104) abutting one another is transmitted to the side wall (11; 12). This leads, for example, to the acceleration sensor responding and triggering the alarm system (16) on the side wall (11; 12) that vibrates in the manner of a membrane, for example. Atypical slat movements can also be detected by the sensor. For example, chatter marks can be provided on the slat rail (81) in order to generate detectable vibrations for the alarm system (16) when the slats (91-104) are passed over.

After a product has been removed, the slats (91-104) can, for example, automatically return to their starting position. For this purpose, for example, spring elements can be arranged on the slat rail (81) between the slats (91-104). These can, for example, be compression springs in the form of spiral springs, bending springs, etc. The above-mentioned total width (b) of a slats (91; 92; 93; 94; 95; 96; 97; 98; 99; 101; 102) then comprises, for example, half of the compressed spring element on both sides. It is also conceivable, for example, to provide cone elements on the slat rail (81) as an alternative or in addition to the spring elements. These have, for example—when using return springs—an incline of up to 10 degrees. The slope is the angle enclosed by the center line of the cone and a generating line. In the case of an embodiment of the merchandise display device (10) without a return spring, the cone slope is, for example, in the range of 15 degrees. Instead of a cone, one or more wedges can also be provided. In this way, the slat (91-104) is slightly inhibited after being pushed open under the load on the spring element. As soon as, for example, an impulse is exerted on the merchandise display device (10), the individual slats (91; 92; 93; 94; 95; 96; 97; 98; 99; 101; 102; 103; 104) is returned to its starting position by the spring elements. A trigger pulse of this kind can occur, for example, by engaging another slat (91; 92; 93; 94; 95; 96; 97; 98; 99; 101; 102; 103; 104). Other versions of a delayed reset, for example, are also conceivable.

The individual slat (91; 92; 93; 94; 95; 96; 97; 98; 99; 101; 102; 103; 104) can also have a conical seat on one side oriented in the transverse direction (6) and a cone receptacle on the other side. This allows the slats (91-104) to be pushed into one another when a merchandise compartment (21-32) is opened. The width (b) of the individual slat (91; 92; 93; 94; 95; 96; 97; 98; 99; 101; 102) in this case of a springless design is the width of the transverse guide area (114) without the conical seat. In an embodiment with a return spring, the width (b) of an individual slat (91-104) includes the extent of the compressed return spring in the transverse direction (6).

It is also conceivable to arrange the slats (91-102) in a non-aligned manner on the slat rail (81). The slats (91-102) can be offset from one another in the longitudinal direction (5). The adjacent slats (91, 92; 92, 93; 93, 94; 94, 95; 95, 96; 96, 97; 97, 98; 98, 99; 99, 101; 101, 102; 102, 103; 103, 104) can be contacted with one another in such an embodiment, for example in the area of their upper guide. Even with a curved slat rail (81), the slats (91-104) are shifted as described above.

To replace the insert unit (80), for example, the retaining pins (82) on both sides are released. The slat rail (81) with the slats (91-104) can then be removed. New and different slats (91-104), for example, can now be pushed onto the slat rail (81), as described above. These new slats (91-104) can, for example, have a division adapted to new merchandise compartments (21-32), carry different advertising messages, etc. The new or newly assembled insert unit (80) can then be inserted into the side walls (11, 12) as described above.

To replace the merchandise display device (10), it may be removed from the shelf as a whole. For example, a new merchandise display device (10) can now be used or the shelving unit can continue to be used as a conventional shelving unit.

Figure 9:
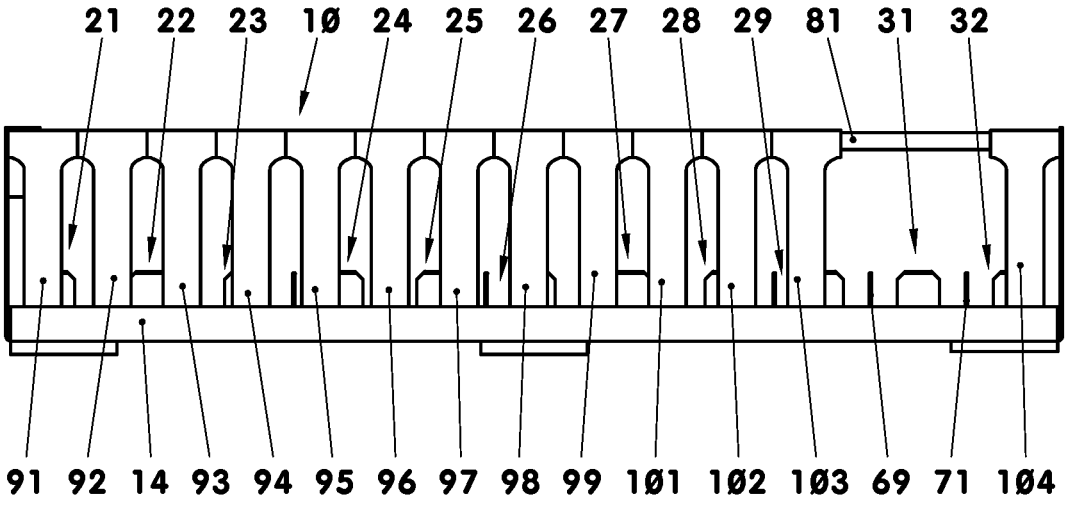
FIG. 9 is a front view of a merchandise display device with slats according to FIG. 7.

FIG. 9 shows an embodiment of a merchandise display device (10) with the slats (91-104) shown in FIG. 7. The number and the individual width of the merchandise compartments (21-32) correspond, for example, to the design of FIGS. 1-6. Each of the merchandise compartments (21-32) has the width (w). This width (w) is, for example, the useful width of the individual merchandise compartment (21-32) between the merchandise dividers (61, 62; 62, 63; 63, 64; 64, 65; 65, 66; 66, 67; 67, 68; 68, 69; 69, 71) or between a merchandise divider (61; 71) and a side wall (11; 12). The individual merchandise compartments (21-32) are, for example, counted from left to right with the whole natural numbers 1 to n, the number i being an integer from this number range and k being a counting variable.

The merchandise display device (10) shown in FIG. 9 has, for example, 13 slats (91-104). Each of these slats (91-104) has a width (b). The individual slats are numbered, for example, from 1 to m with whole natural numbers, the number j being a number from this number range and p being a counting variable. For each merchandise compartment (21; 22; 23; 24; 25; 26; 27; 28; 29; 31; 32) with the location number (i) the following applies:

$$\sum_{1}^{i-1} w_k > \sum_{1}^{j} b_p - v_j$$

and $$\sum_{i+1}^{n} w_k > \sum_{j+1}^{m} b_p - u_{j+1}$$

The sum of the widths of all the merchandise compartments lying on the left of this merchandise compartment (i) in a front view is greater than the sum of the widths of the slats that can be arranged on the left of the merchandise compartment i, reduced by the width of the overhang (123) oriented towards the goods compartment. The sum of the widths of all the merchandise compartments to the right of this merchandise compartment (i) is greater than the sum of the widths of the slats that can be arranged to the right of the merchandise compartment (i), reduced by the width of the overhang (119) oriented towards the merchandise compartment. In the case of a curved slat rail (81), the slats (91-104) can be viewed, for example, along the unwound slat rail (81).

Furthermore, the following applies to each merchandise compartment (21; 22; 23; 24; 25; 26; 27; 28; 29; 31; 32) with the location number (i):

$$0 < \sum_{1}^{n} w_k - w_i - \sum_{1}^{m} b_p + v_j + u_{j+1} < 0.75 * (\mathrm{MIN}(w_{i-1}; w_{i+1}))$$

The sum of the widths of all other merchandise compartments and the overhangs (u, v) of the immediately adjacent slats, reduced by the sum of the width of all slats (91-102) is greater than zero and less than three quarters of the width of the narrower of the immediately adjacent compartments.

Under the geometrical conditions mentioned, the slats (91-104) with the serial numbers (j) and (j+1) are pushed apart in this exemplary embodiment as well, thus releasing the merchandise compartment (21; 22; 23; 24; 25; 26; 27; 28; 29; 31; 32) with the serial number (i). All other merchandise compartments are closed by means of the slats (91-104).

The assembly, the operation, the response of the alarm system (16) and the exchange take place as described above in connection with the first exemplary embodiment.

Combinations of the exemplary embodiments are also conceivable.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

LIST OF REFERENCE SYMBOLS

5 Longitudinal direction
6 Transverse direction
7 Height direction
10 Merchandise display device
11 Side wall
12 Side wall
13 Base plate, base part
14 Front strip
15 Guide gap, guide groove
16 Alarm system
17 Side wall bore
18 Dispensing area
19 Securing strip
21-32 Merchandise compartments
40 Pre-assembly group
41 Support profile
42 Support surfaces
43 Merchandise slide
44 Front anchor
45 Rear anchor
51 Front stop bar
52 Transverse bar
53 Front stop
57 Rear transverse bar
61-71 Merchandise divider
80 Insert unit
81 Slat rail, slat rail
82 Retaining pin
83 Collar
84 Cylindrical area
91-104 Slats
111 Guide lug
112 Guide lug
113 Receiving bore
114 Transverse guide area
115 Tongue
116 Tongue area
117 Edge of tongue, left
118 Edge of (114), left
119 left overhang, (u)
121 right edge of tongue
122 Edge of (114), right
123 Right overhang, (v)
124 Visible side
131 Engagement recesses
132 Vertical slot

What is claimed is:

1. A merchandise display device (10), comprising:

a base plate (13);

two side walls (11, 12) connected to and extending upwardly from the base plate (13);

a plurality of merchandise compartments (21-32), arranged above the base plate (13) between the two side walls (11, 12) and separated from one another by a merchandise divider (61; 62; 63; 64; 65; 66; 67; 68; 69; 71);

slidable slats (91-104) delimiting the plurality of merchandise compartments (21-32) in a common dispensing area (18); and a slat rail (81) carrying the slidable slats (91-104), the slat rail (81) being fastened in both side walls (11, 12), wherein the slidable slats (91-104) hang on the slat rail (81), and wherein the merchandise display device (10) is configured to be mounted on and removed from a shelf as a complete assembly.

2. The merchandise display device (10) according to claim 1, wherein the base plate (13) and the side walls (11, 12) are one piece.

3. The merchandise display device (10) according to claim 1, wherein a thickness of at least one side wall (11; 12) is less than 20% of a maximum dimension of the slat rail (81) in a plane normal to a longitudinal direction (5) of the merchandise display device (10).

4. The merchandise display device (10) according to claim 1, further comprising an alarm system (16).

5. The merchandise display device (10) according to claim 4, wherein the alarm system (16) includes an acceleration sensor.

6. The merchandise display device (10) according to claim 4, wherein the alarm system (16) is attached to one of the two side walls (11; 12) at least half a height of one of the plurality of merchandise compartments (21-32) spaced from the base plate (13).

7. The merchandise display device (10) according to claim 4, wherein the slat rail (81) has chatter marks over which the slats (91-104) can pass.

8. The merchandise display device (10) according to claim 1, wherein the slat rail (81) with the slats (91-104) forms an insert unit (80) for fastening in the side walls (11, 12).

9. The merchandise display device (10) according to claim 1, wherein each slat (91-104) has a transverse support section (114) and a tongue area (116), and wherein a number of slats (91-104) is greater than or equal to a number of merchandise compartments (21-32) reduced by one.

10. The merchandise display device (10) according to claim 9, wherein each slat (91; 92; 93; 94; 94; 96; 97; 98; 99; 101; 102; 103; 104) is guided in a guide groove (15) that is spaced apart from the slat rail (81).

11. The merchandise display device (10) according to claim 10, wherein the tongue area (116) is guided in the guide groove (15).

12. The merchandise display device (10) according to claim 10, wherein each merchandise compartment (21; 22; 23; 24; 25; 26; 27; 28; 29; 31; 32 has a front anchor (44).

13. The merchandise display device (10) according to claim 12, wherein a front stop bar (51) bearing the front anchor (44) delimits the guide groove (15).

14. The merchandise display device (10) according to claim 9, wherein, in a front view of the merchandise display device (10), for any one selected merchandise compartment (21; 22; 23; 24; 25; 26; 27; 28; 29; 31; 32 of the plurality of merchandise compartments a sum of widths of all merchandise compartments (21; 22; 23; 24; 25; 26; 27; 28; 29; 31; 32) arranged left of the selected merchandise compartments is greater than a sum of widths of the slats (91-104) that can be arranged left of the selected merchandise compartment (21; 22; 23; 24; 25; 26; 27; 28; 29; 31; 32), reduced by a width of an overhang (123) of a transverse support section (114) oriented towards the selected merchandise compartment (21; 22; 23; 24; 25; 26; 27; 28; 29; 31; 32) over a tongue area (116), and a sum of the widths of all merchandise compartments (21; 22; 23; 24; 25; 26; 27; 28; 29; 31; 32) arranged right of the selected merchandise compartment (21; 22; 23; 24; 25; 26; 27; 28; 29; 31; 32 is greater than a sum of the widths of the slats (91-104) that can be arranged right of the selected merchandise compartment (21; 22; 23; 24; 25; 26; 27; 28; 29; 31; 32), reduced by a width of an overhang (119) facing the selected merchandise compartment (21; 22; 23; 24; 25; 26; 27; 28; 29; 31; 32); and wherein for each merchandise compartment (21; 22; 23; 24; 25; 26; 27; 28; 29; 31; 32) a sum of widths of all other merchandise compartments and the overhangs (119, 123) of an immediately adjacent slat (91, 92; 92, 93; 93, 94; 94, 95; 95, 96; 96, 97; 97, 98; 98, 99; 99, 101; 101, 102; 102, 103; 103, 104), reduced by the sum the width of all of the slidable slats (91-104), is greater than zero and less than three quarters of the width of a narrower one of an immediately adjacent merchandise compartments.

15. The merchandise display device (10) according to claim 9, wherein for each slat (91-104) a width of the transverse support section (114) is greater than or equal to a width of the tongue area (116).

16. The merchandise display device (10) according to claim 9, wherein the transverse support section (114) is guided on the slat rail (81).

17. The merchandise display device (10) according to claim 1, wherein individual merchandise compartments (21-32) and/or individual slats (91-104) have a different width.

18. The merchandise display device (10) according to claim 1, wherein the slat rail (81) is tubular, and wherein each of the slidable slats (91-104) comprises, in an upper area of the respective slat, two parallel guide lugs (111, 112), wherein the slat rail (81) extends through receiving bores (113) that penetrate the respective guide lugs (111,112).

19. The merchandise display device (10) according to claim 1, wherein each of the slidable slats (91; 92; 93, 94; 95; 96; 97; 98; 99; 101; 102; 103; 104) has at least one engagement recess (131).

20. The merchandise display device (10) according to claim 1, wherein the merchandise compartments (21-32) are arranged parallel to one another.

21. The merchandise display device (10) according to claim 1, wherein each of the merchandise compartments (21; 22; 23; 24; 25; 26; 27; 28; 29; 31; 32) has a merchandise slide (43) spring-loaded towards the dispensing area (18).

22. The merchandise display device (10) according to claim 1, wherein the slats (91-104) are spring-loaded relative to one another and to at least one side wall (11; 12).

23. The merchandise display device (10) according to claim 1, wherein the slats (91-104) each have a conical receptacle and/or a conical seat.

24. The merchandise display device (10) according to claim 1, wherein a height of the merchandise divider (61; 62; 63; 64; 65; 66; 67; 68; 69; 71 is at least 30% of a height of an adjacent merchandise compartment (21; 22; 23; 24; 25; 26; 27; 28; 29; 31; 32).

25. The merchandise display device (10) according to claim 1, wherein at least one of the slats (91; 92; 93; 94; 95; 96; 97; 98; 99; 100; 101; 102; 103; 104) can be locked relative to the base plate (13).

26. The merchandise display device (10) according to claim 1, wherein the merchandise display device (10) is movably arranged in pull-out rails attached to a shelf.

27. The merchandise display device (10) according to claim 1, wherein the merchandise compartments (21-32) are upwardly open.

* * * * *